US007347723B1

(12) United States Patent
Daily

(10) Patent No.: US 7,347,723 B1
(45) Date of Patent: Mar. 25, 2008

(54) SEALED CONNECTOR SYSTEM FOR ELECTRONIC DEVICES

(75) Inventor: Christopher G. Daily, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/559,625

(22) Filed: Nov. 14, 2006

(51) Int. Cl.
*H01R 13/52* (2006.01)

(52) U.S. Cl. ..... 439/519; 439/271

(58) Field of Classification Search ..... 439/271–273, 439/278, 519, 521
See application file for complete search history.

(56) References Cited

U.S. PATENT DOCUMENTS 6,910,904 B2 * 6/2005 Herrick et al. ..... 439/271
7,077,676 B2 * 7/2006 Matsumoto et al. ..... 439/271
7,097,483 B2 * 8/2006 Hayashi ..... 439/271
7,168,971 B2 * 1/2007 Manson et al. ..... 439/271
7,182,640 B2 * 2/2007 Garrett et al. ..... 439/587

OTHER PUBLICATIONS

Internet, Molex®—Battery Connectors, Feb. 20, 2007, pp. 1-3.

* cited by examiner

*Primary Examiner*—Khiem Nguyen

(57) ABSTRACT

A system for connecting electronic components to one another in a sealed or sealable manner is provided. This system includes: a first electronic component, wherein the first electronic component further includes a first connector mounted therein, and wherein the first connector further includes a plurality of contact surfaces; a second electronic component for communicating with the first electronic component, wherein the second electronic component further includes a second connector mounted therein, and wherein the second connector further includes a plurality of contact surfaces corresponding to the plurality of contact surfaces on the first connector; means for sealing a portion of the first connector within the first electronic component; and means for sealing a portion of the second connector within the second electronic component.

19 Claims, 14 Drawing Sheets

SEALED CONNECTOR SYSTEM FOR ELECTRONIC DEVICES

BACKGROUND OF THE INVENTION

The described invention relates in general to a connector system for use with electronic devices and more specifically to a sealed or sealable connector system for use with a hand-held scanning device and docking station.

In electronics, printed circuit boards (PCBs) are used to mechanically support and electrically connect electronic components using conductive pathways, or traces, etched from copper sheets laminated onto a non-conductive substrate. Alternative names are printed wiring board or PWB or etched wiring board. After populating the board with electronic components, a printed circuit assembly (PCA) is formed. PCBs are rugged, inexpensive, and can be highly reliable. They require much more layout effort and higher initial cost than either wire-wrapped or point-to-point constructed circuits, but are much cheaper, faster, and consistent in high volume production. PCBs are widely used in the electronics industry in a variety of products including computers, servers, televisions and telecommunication devices.

In addition to the aforementioned applications, PCBs are often included in electronic devices such as hand-held scanners and docking stations that communicate electronically and exchange information with such scanners. These devices are often used in the field in environments that are harsh and/or unpredictable. Electrical connectors that are typically included on hand-held scanners and docking stations me be damaged or rendered inoperative by exposure to water, dirt, grease, or other contaminants found in the physical environment. Many currently available connectors that are compatible with hand-held devices do not provide adequate durability and protection against possible damage. Thus, there is an ongoing need for a durable and reliable connector system that can be used with electronic components and devices that may be exposed to a variety of unfavorable conditions when in use.

SUMMARY OF THE INVENTION

The following provides a summary of exemplary embodiments of the present invention. This summary is not an extensive overview and is not intended to identify key or critical aspects or elements of the present invention or to delineate its scope.

In accordance with one aspect of the present invention, a system for connecting electronic components is provided. This system includes: a first electronic component, wherein the first electronic component further includes a first connector mounted therein, and wherein the first connector further includes a plurality of contact surfaces; a second electronic component for communicating with the first electronic component, wherein the second electronic component further includes a second connector mounted therein, and wherein the second connector further includes a plurality of contact surfaces corresponding to the plurality of contact surfaces on the first connector; means for sealing a portion of the first connector within the first electronic component; and means for sealing a portion of the second connector within the second electronic component.

In accordance with another aspect of the present invention, a system for connecting a hand-held device and a docking station is provided. This system includes: a docking station, wherein the docking station further includes a first connector mounted therein, and wherein the first connector further includes a plurality of electrical contact surfaces; a hand-held device for communicating electronically with the docking station, wherein the hand-held device further includes a second connector mounted therein, and wherein the second connector further includes a plurality of electrical contact surfaces corresponding to the plurality of electrical contact surfaces on the docking station; gasket means for sealing a portion of the first connector within docking station; and gasket means for sealing a portion of the second connector within the hand-held device.

In yet another aspect of this invention, a method for connecting electrical components to one another is provided. This method includes: providing a first electronic component, wherein the first electronic component further includes a first connector mounted therein, and wherein the first connector further includes a plurality of contact surfaces; providing a second electronic component, wherein the second electronic component further includes a second connector mounted therein, and wherein the second connector further includes a plurality of contact surfaces corresponding to the plurality of contact surfaces on the first connector; providing means for sealing a portion of the first connector within the first electronic component; providing means for sealing a portion of the second connector within the second electronic component; and contacting the first connector with the second connector for enabling electrical communication between the first and second electronic components.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1A:
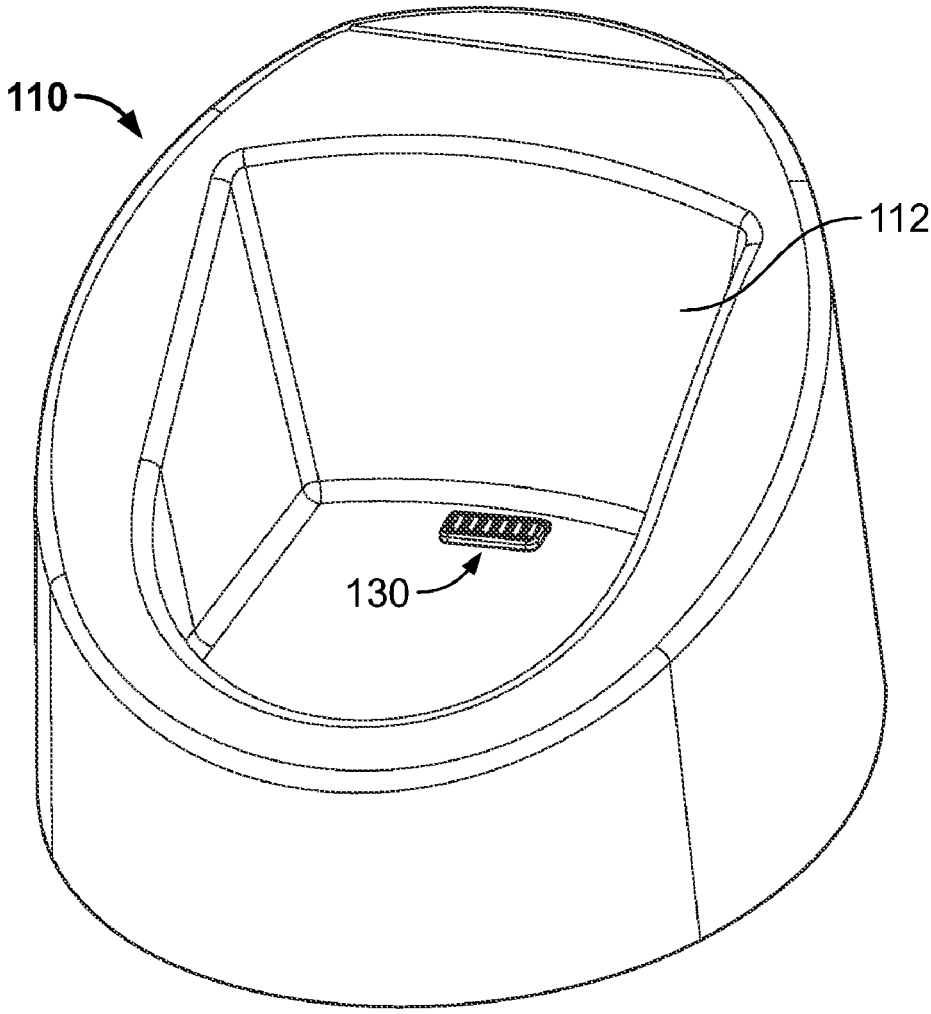
FIG. 1A is a top perspective view of a first exemplary embodiment of the docking station component of the sealed connector system of the present invention showing the placement of the plate connector within the cradle of the docking station.
Figure 1B:
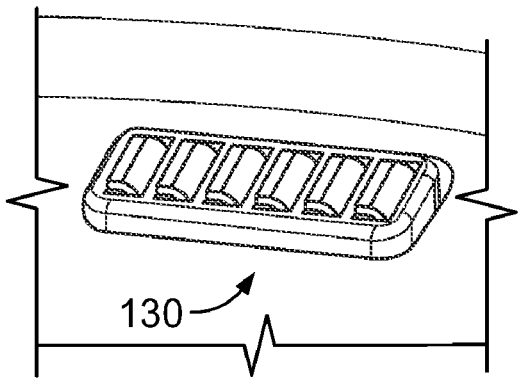
FIG. 1B is a close-up view of the plate connector of FIG. 1A.
Figure 1C:
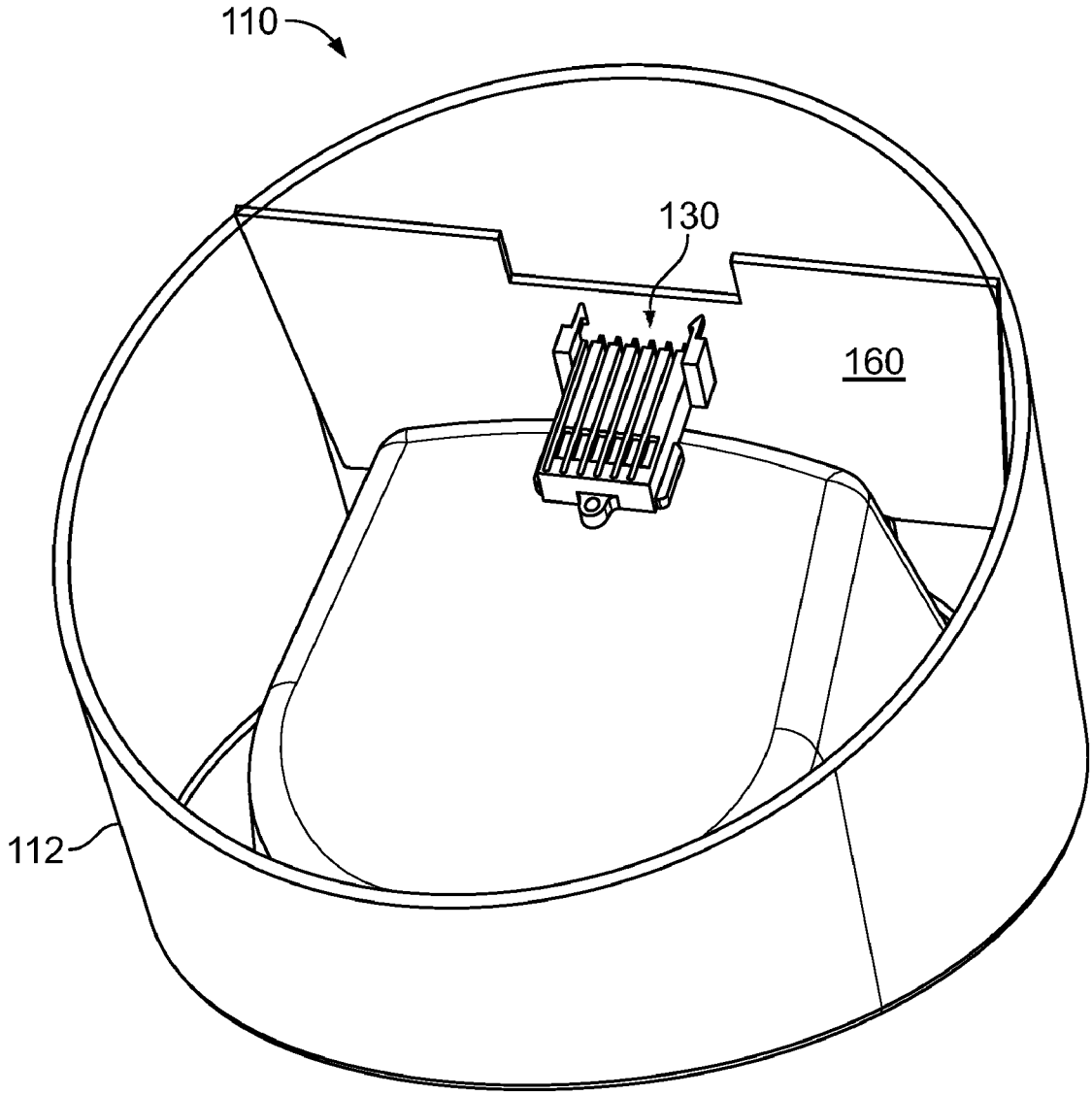
FIG. 1C is a bottom perspective view of the docking station component of FIG. 1A showing the plate connector attached to a first printed circuit board.

Exemplary embodiments of the present invention are now described with reference to the Figures. Reference numerals are used throughout the detailed description to refer to the various elements and structures. In other instances, well-known structures and devices are shown in block diagram form for purposes of simplifying the description. Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

The present invention relates to systems and connectors for electronic devices. An exemplary embodiment of this invention provides a system for connecting electronic components to one another in a sealed or sealable manner, wherein the seal formed between the components is substantially total or complete. This system includes: a first electronic component, wherein the first electronic component further includes a first connector mounted therein, and wherein the first connector further includes a plurality of contact surfaces; a second electronic component for communicating with the first electronic component, wherein the second electronic component further includes a second connector mounted therein, and wherein the second connector further includes a plurality of contact surfaces corresponding to the plurality of contact surfaces on the first connector; gasket means for sealing a portion of the first connector within the first electronic component; and gasket means for sealing a portion of the second connector within the second electronic component.

Figure 1D:
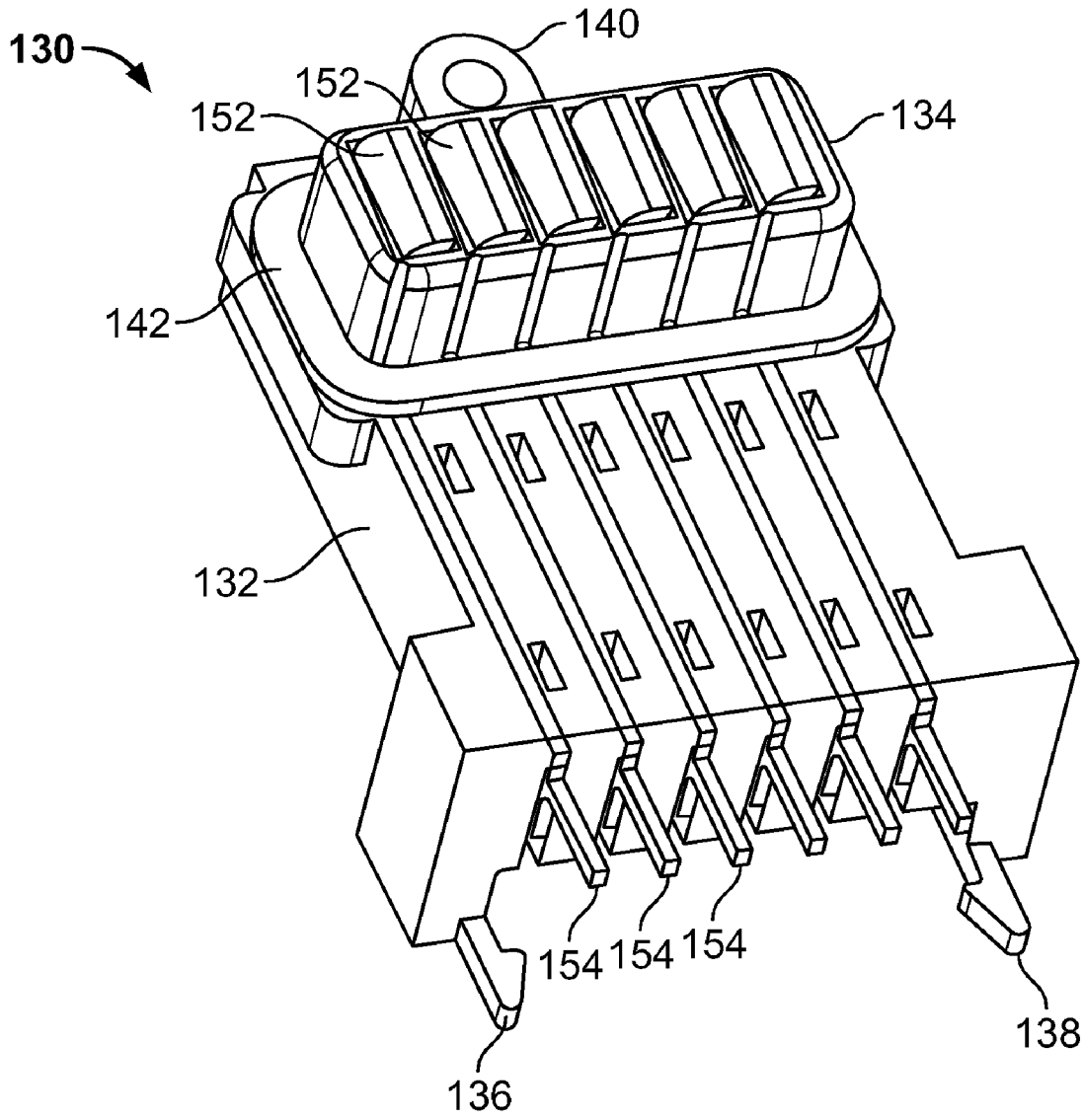
FIG. 1D is a top perspective view of the plate connector.
Figure 1E:
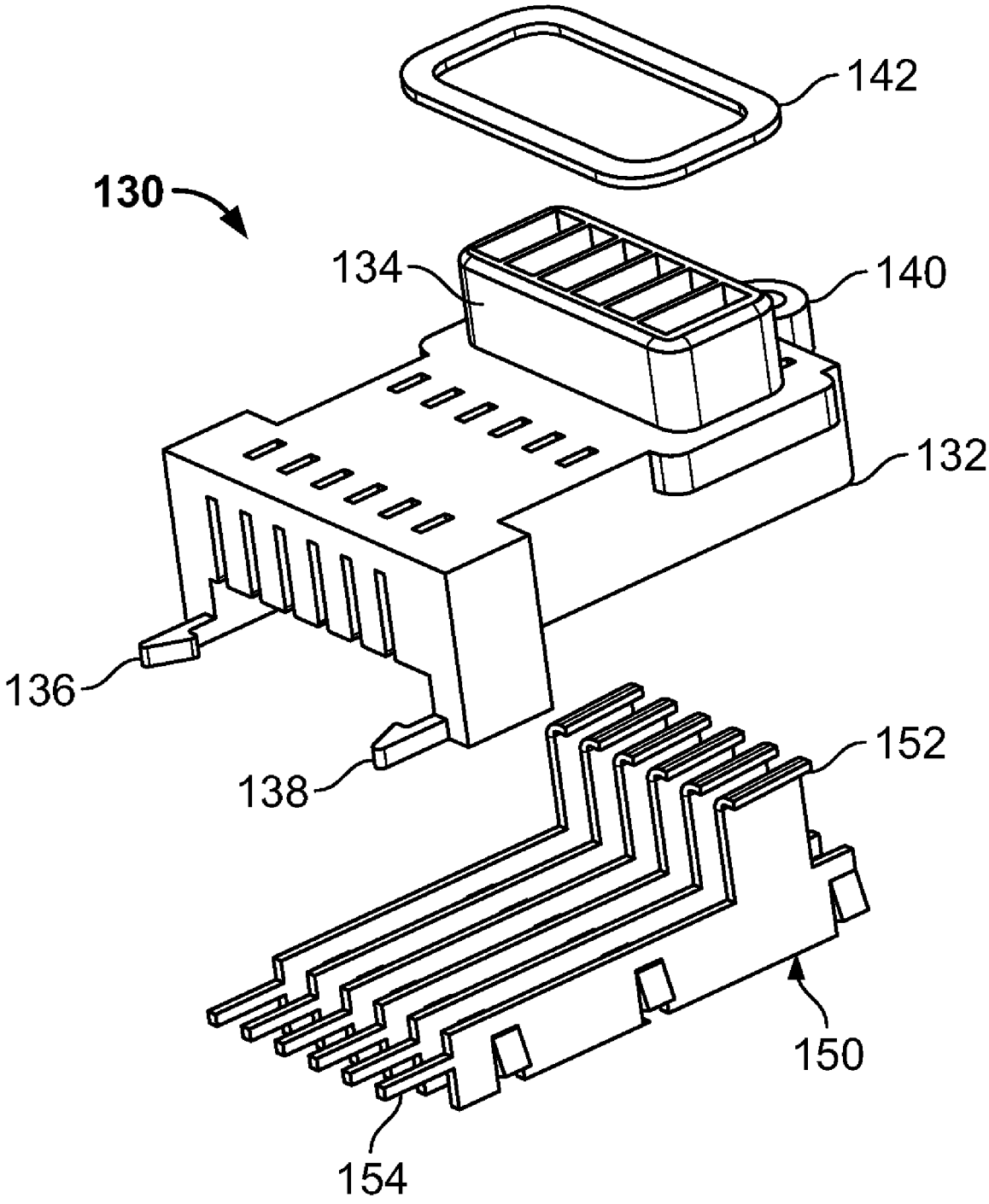
FIG. 1E is an exploded top perspective view of the plate connector showing the primary operative components thereof.
Figure 1F:
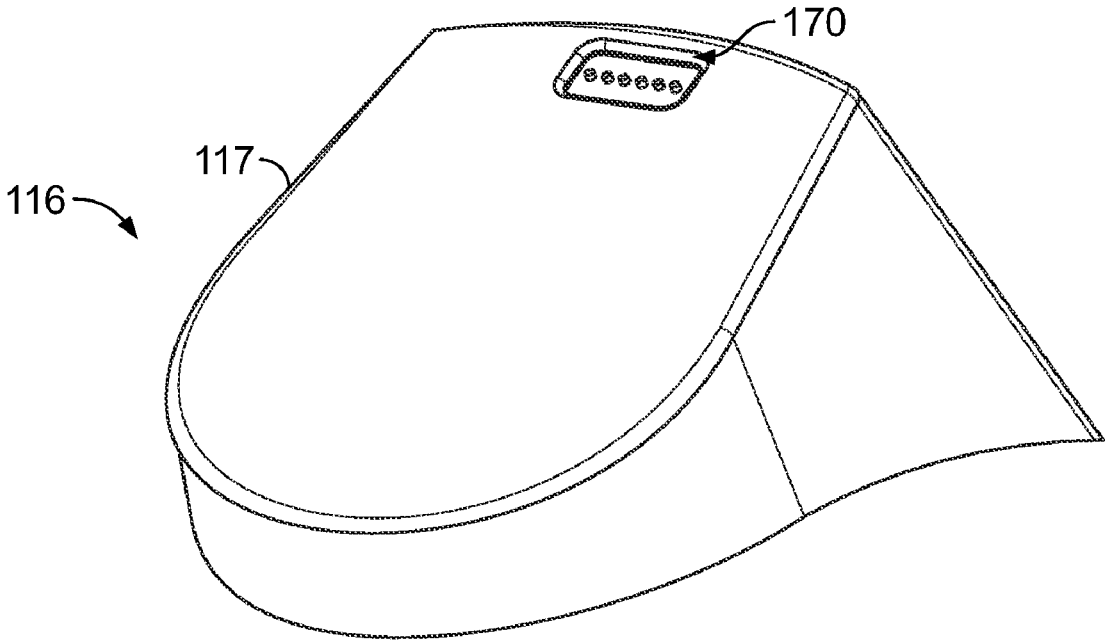
FIG. 1F is a bottom perspective view of a first exemplary embodiment of the hand-held device component of the sealed connector system of the present invention showing the placement of the pin connector within the hand-held device.
Figure 1G:
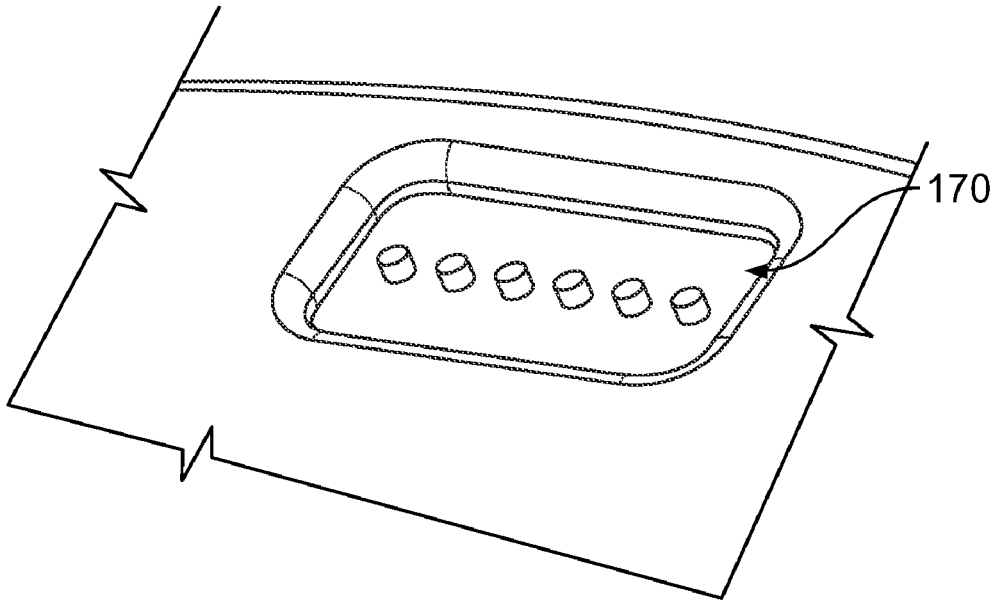
FIG. 1G is a close-up view of the pin connector of FIG. 1F.
Figure 1H:
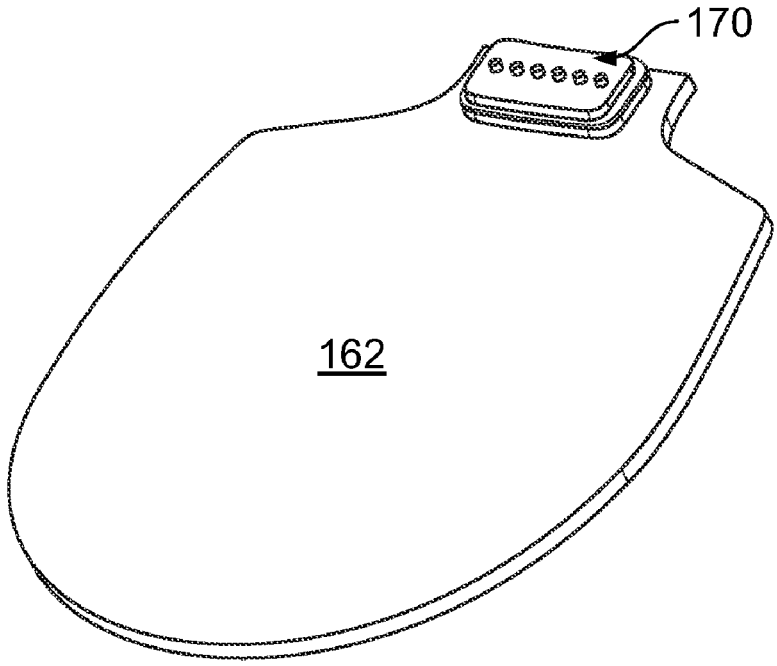
FIG. 1H is a perspective view of the pin connector of FIG. 1F attached to a printed circuit board.
Figure 1I:
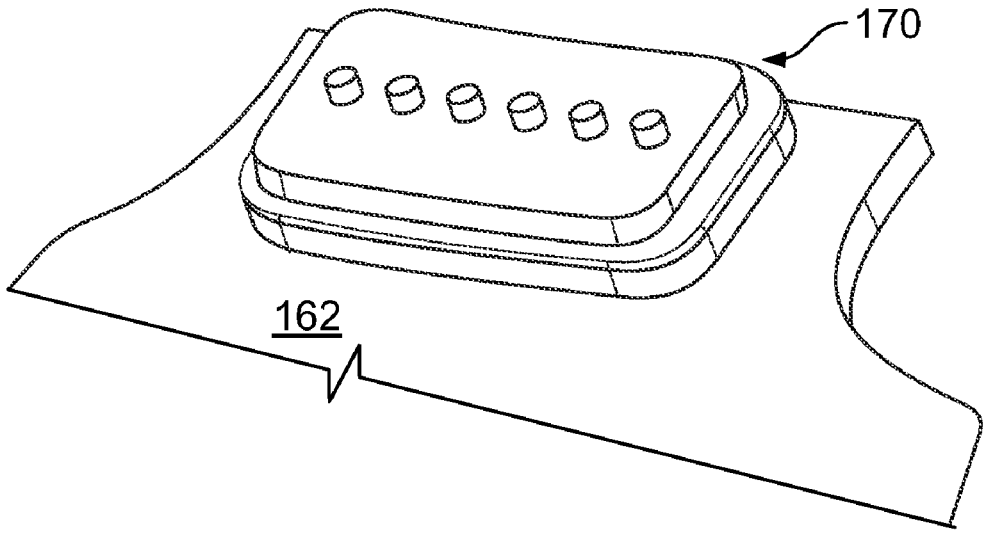
FIG. 1I is a close-up view of the pin connector and printed circuit board of FIG. 1H.
Figure 1J:
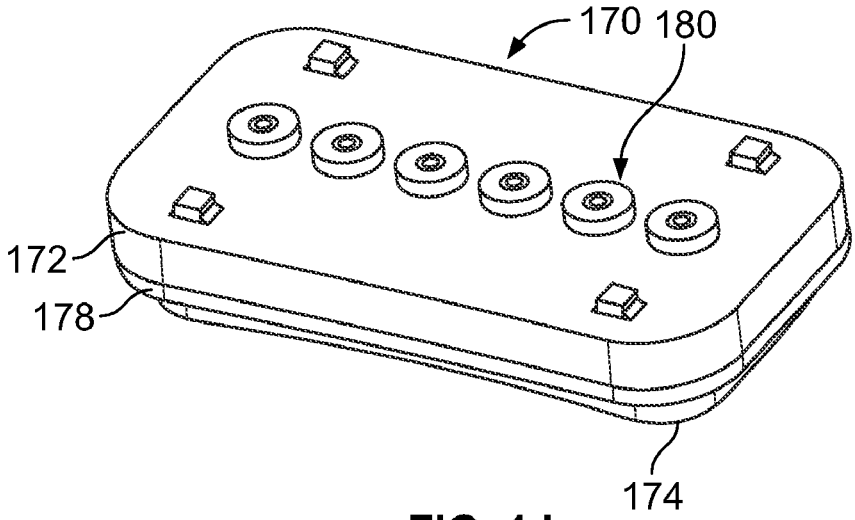
FIG. 1J is a top perspective view of the pin connector.

With reference now to the Figures, FIGS. 1A-1L provide various views of a first exemplary embodiment of the sealed connector system of the present invention. Connector system 100 includes: a docking station 110 having a cradle 112, which is adapted to receive hand-held device 116, a first electronic connector referred to herein as a compliant beam connector or beam connector 130, and first printed circuit board 160. Beam connector 130 includes a connector body 132, which further includes an upper portion 134, first and second connector latches 136 and 138, and screw housing 140 for securing connector body 132 to the bottom side of docking station 110. As best shown in FIGS. 1D-1E, a plurality of individual electrical contacts 150, having substantially flat or planar contact faces 152, are inserted into connector body 132 such that each contact face 152 protrudes slightly from upper portion 134 and each solder tab 154, which contacts first PCB 160, protrudes from connector body 132 between first and second connector latches 136 and 138. In the exemplary embodiment, the manufacturing process of insert molding is used to form a complete seal between connector body 132 and contact faces 152. As will be appreciated by the skilled artisan, insert molding is an injection molding process whereby plastic is injected into a cavity and around an insert piece placed into the same cavity just prior to molding, thus the term insert molding. The result of insert molding is a single piece with the insert encapsulated by the plastic. A face gasket 142 encircles upper portion 134 and forms a seal with the body of docking station 110 within bottom of cradle 112 (see FIGS. 1A-1B).

As shown in FIGS. 1F-1K, hand-held device 116, which may be a scanner, bar-code reader or the like, includes a base 117, a second electronic connector referred to herein as "pin connector" 170, and a second printed circuit board 162. Pin connector 170 includes a lower body portion 172, an upper body portion 174, a plurality of apertures 176 for receiving a plurality of contact pins 180, and a gasket 178 for encircling upper body portion 174 and forming a seal with the body of hand-held device 116 on base 117. Each contact pin 180 is typically spring-loaded and a portion thereof extends from upper body portion 174 to contact a corresponding plated connector 130 in docking station 110. Pin connector 170 may be secured to second printed circuit board 162 by solder reflow or other methods known to the skilled artisan.

Figure 1K:
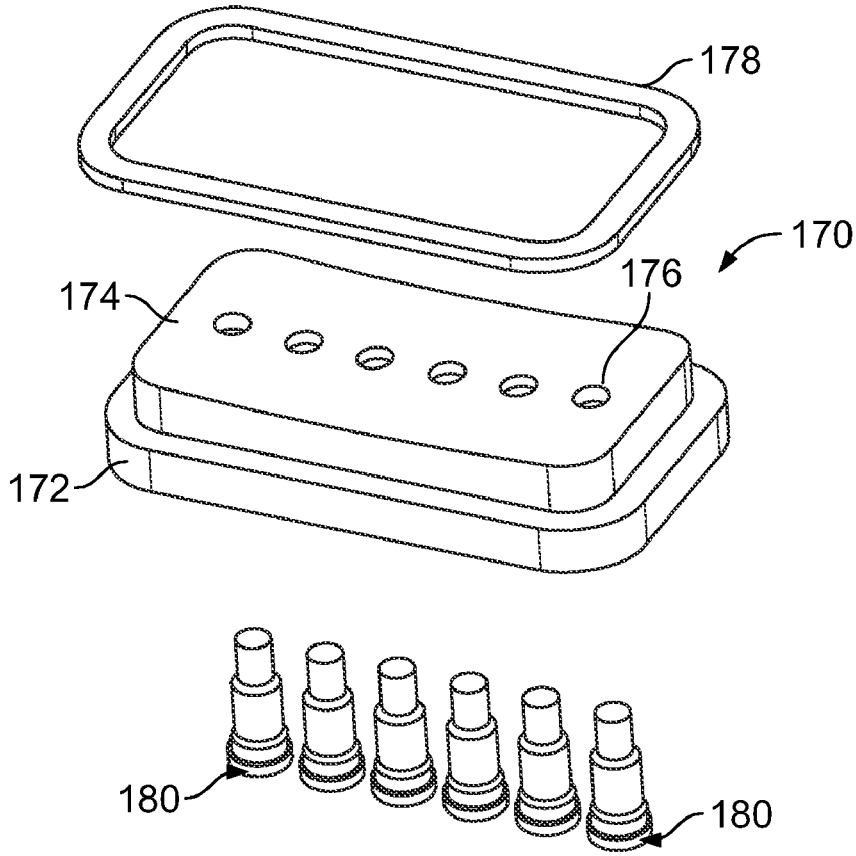
FIG. 1K is an exploded top perspective view of the pin connector showing the primary operative components thereof.
Figure 1L:
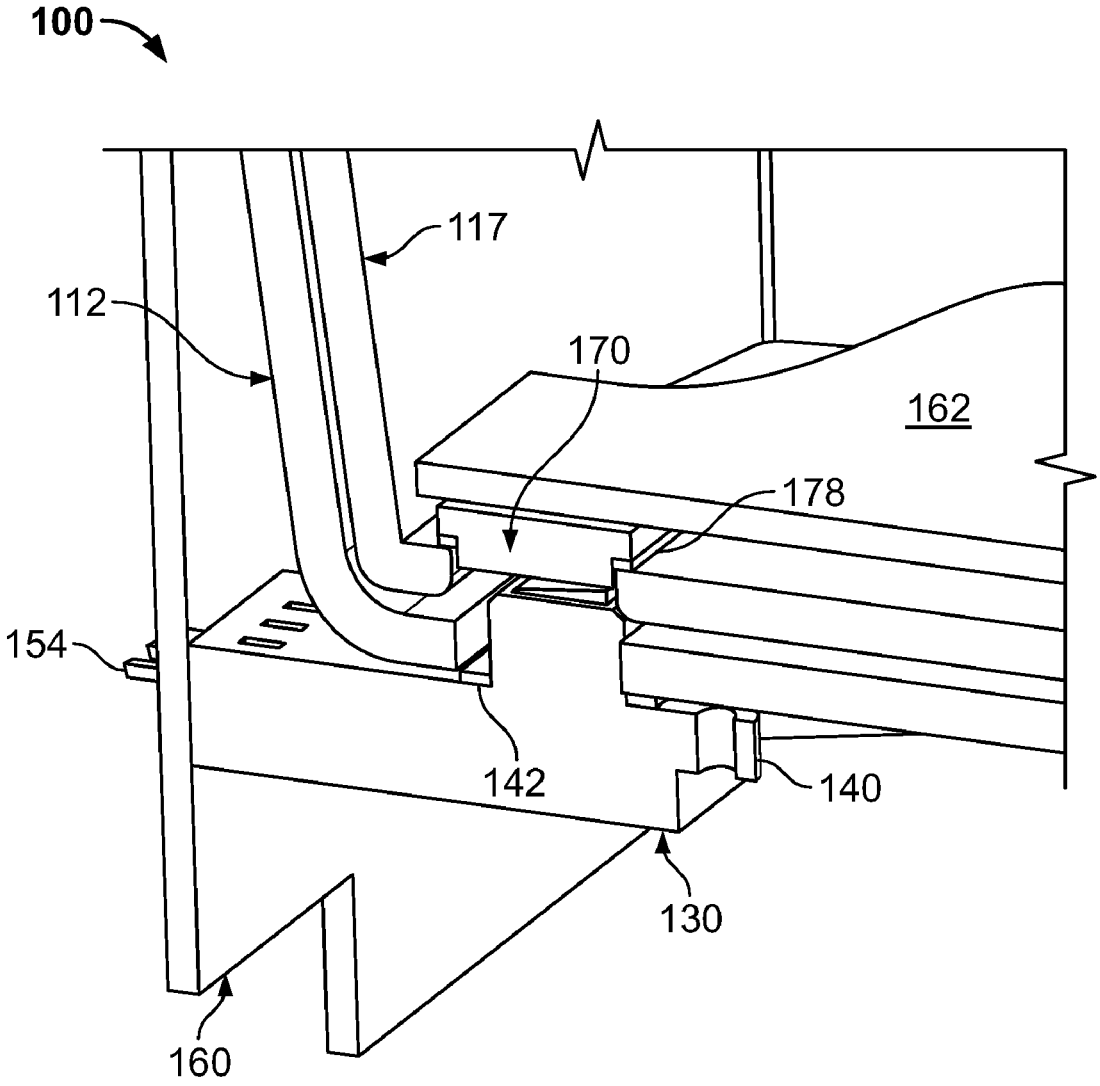
FIG. 1L is a cross-sectional view of a first exemplary embodiment of the sealed connector system of the present invention showing the two connectors in contact with one another.

FIG. 1L provides a cross-sectional view of hand-held device 116 seated in docking station 110, wherein connectors 130 and 170 are in contact with one another to enable electrical communication between printed circuit boards 160 and 162. Gaskets 142 and 178, which may be rubber, plastic, or any other suitable material, seal the openings in docking station 110 and hand-held device 116 in which connectors 130 and 170 are mounted, thereby protecting printed circuit boards 160 and 162 from being damaged by water, oil, dirt or other contaminants.

FIGS. 2A-2K provide various views of a second exemplary embodiment of the sealed connector system of the present invention. Connector system 200 includes: a docking station 210 having a cradle 212, which is adapted to receive hand-held device 216, a first electronic connector referred to herein as "pin connector" 270 and housing a plurality of contact pins 280, and a first printed circuit board 260. The construction and function of pin connector 270 is essentially the same as that described above for pin connector 170, the primary difference being that in this embodiment, the pin connector is mounted in the docking station rather than in the hand-held device component of the system. Each contact pin 280 is typically spring-loaded and a portion thereof contacts plated connectors 230 when the system is assembled.

Figure 2A:
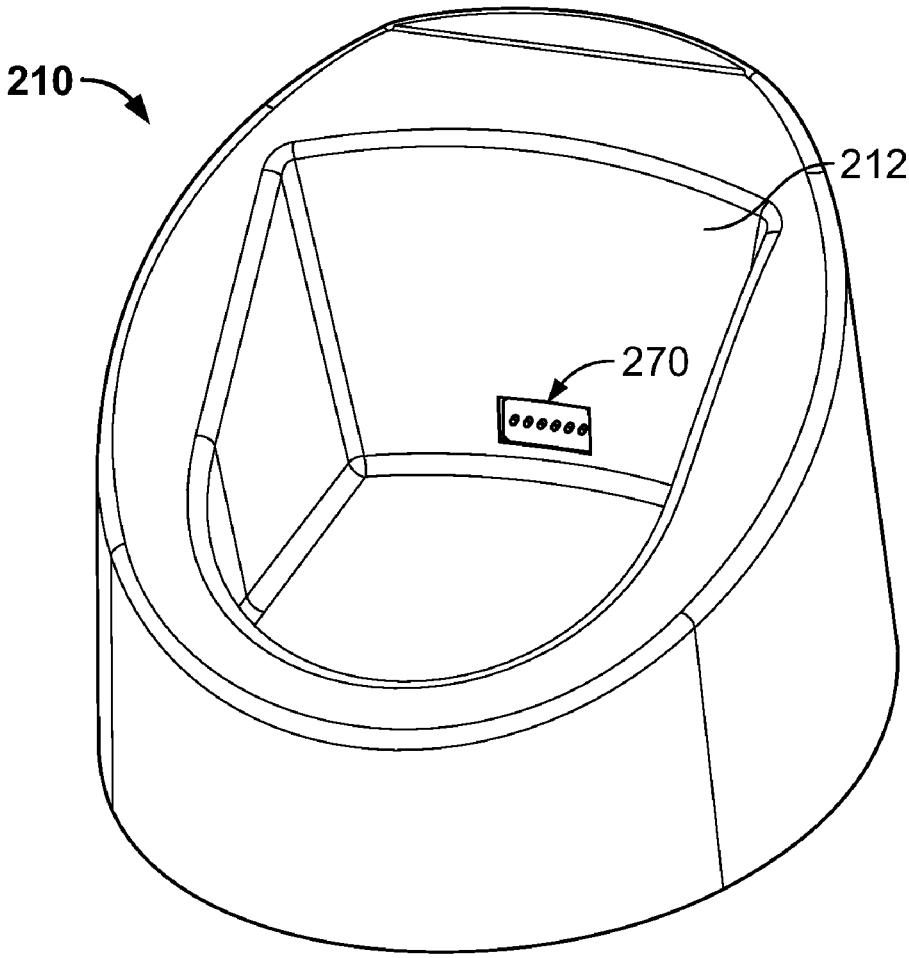
FIG. 2A is a top perspective view of a second exemplary embodiment of the docking station component of the sealed connector system of the present invention showing the placement of the pin connector within the cradle of the docking station.
Figure 2B:
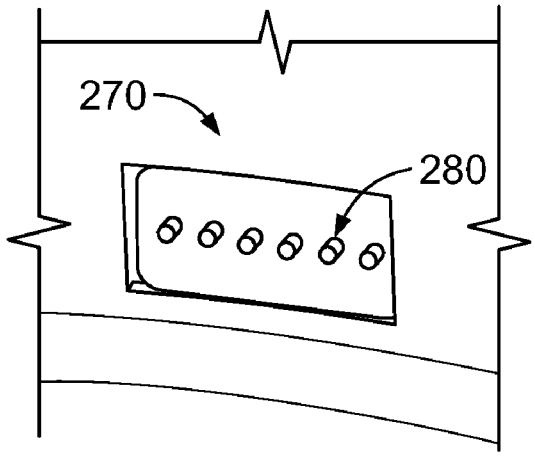
FIG. 2B is a close-up view of the pin connector of FIG. 2A.
Figure 2C:
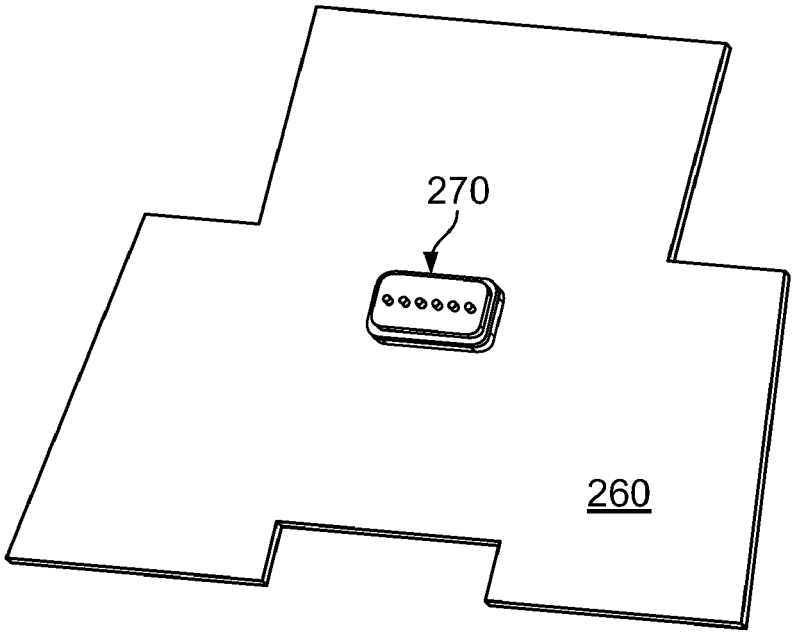
FIG. 2C is a close-up view of the pin connector of FIG. 2A shown attached to a printed circuit board.
Figure 2D:
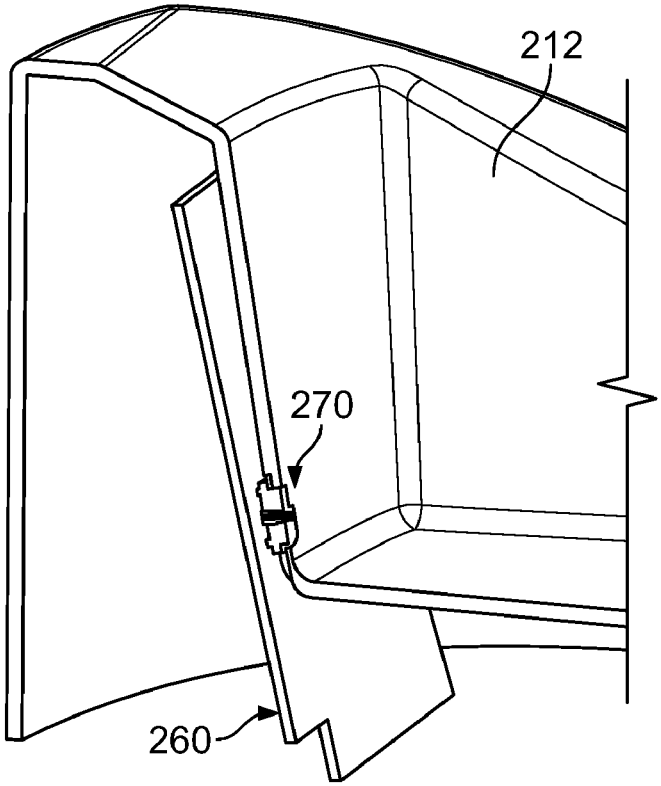
FIG. 2D is a cross-sectional view of the pin connector shown attached to a printed circuit board and extending through the body of the docking station.
Figure 2E:
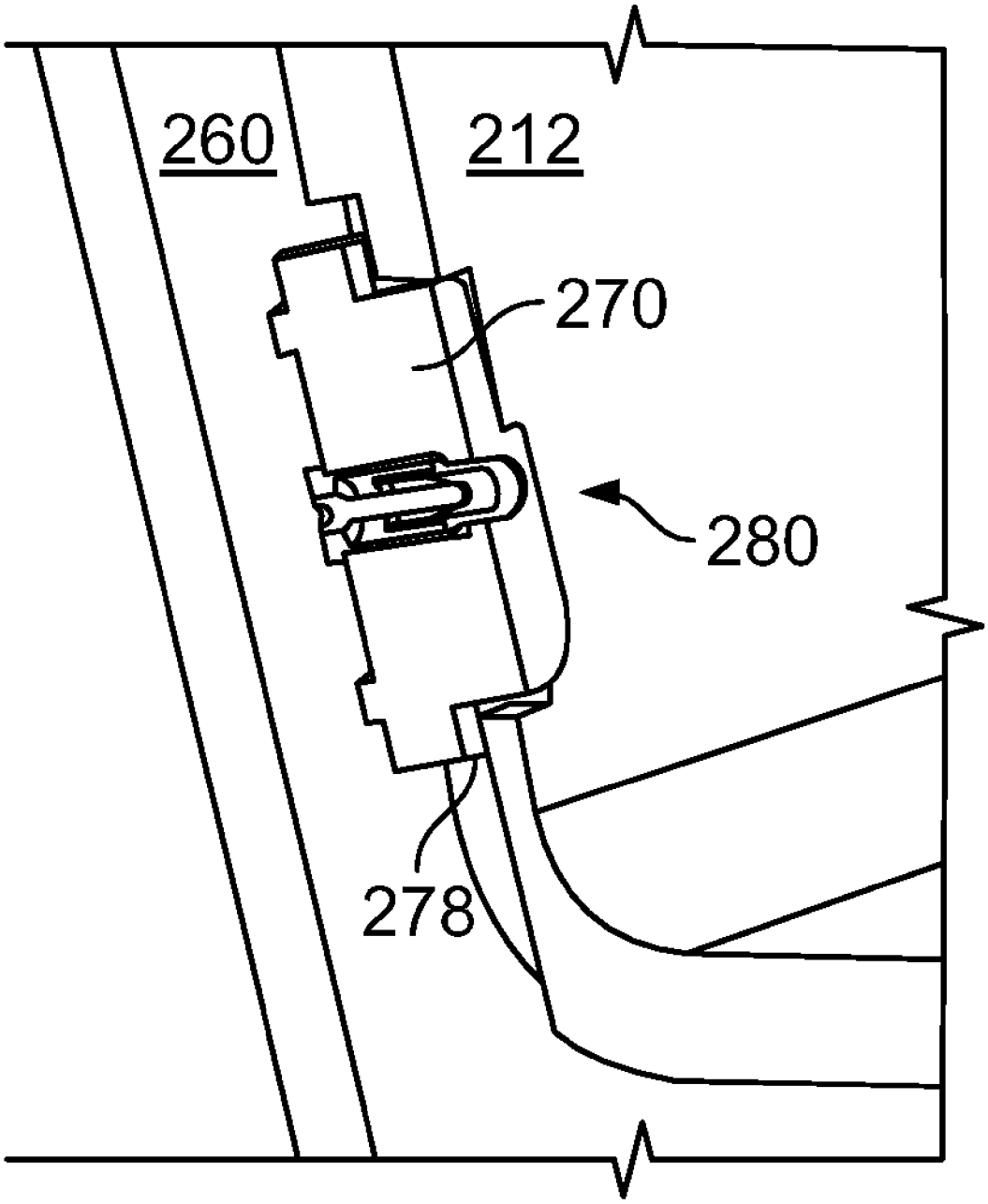
FIG. 2E is a close-up of the pin connector as shown in FIG. 2D.
Figure 2F:
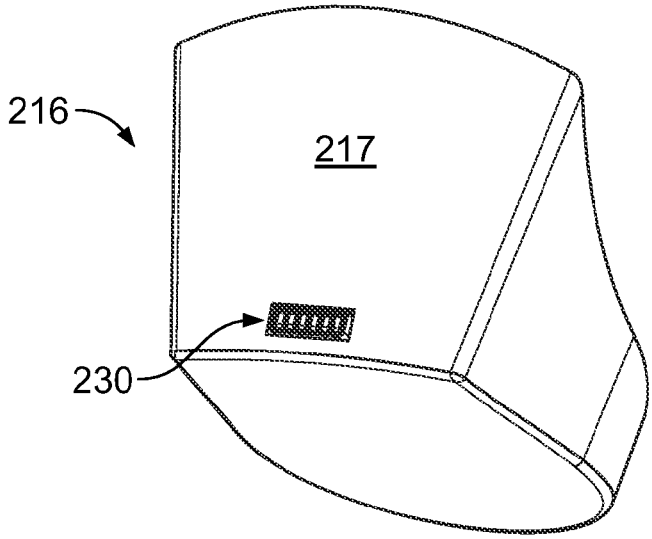
FIG. 2F is a rear perspective view of a second exemplary embodiment of the hand-held device component of the sealed connector system of the present invention showing the placement of the plate connector within the hand-held device.
Figure 2G:
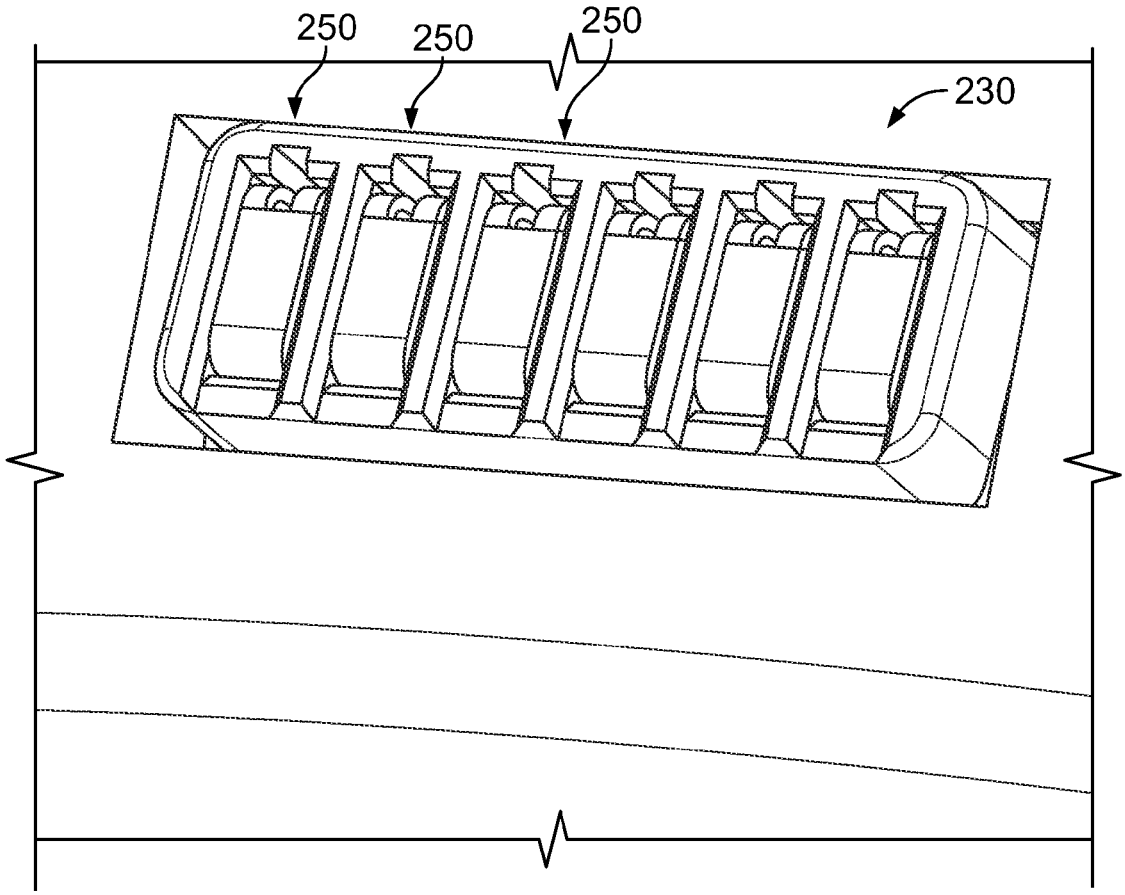
FIG. 2G is a close-up view of the plate connector shown in FIG. 2F.
Figure 2H:
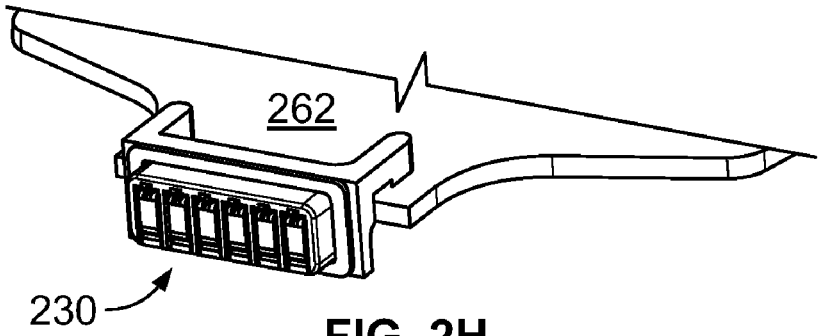
FIG. 2H is a front perspective view of the plate connector attached to a printed circuit board.
Figure 2I:
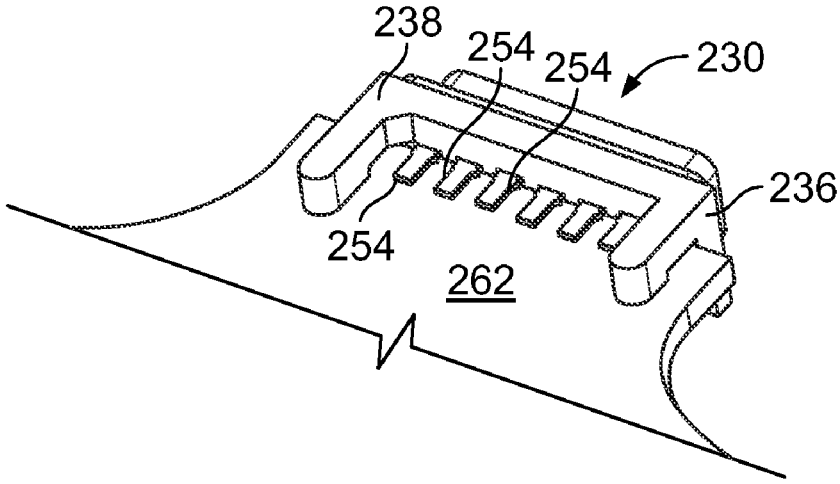
FIG. 2I is a rear perspective view of the plate connector attached to a printed circuit board.
Figure 2J:
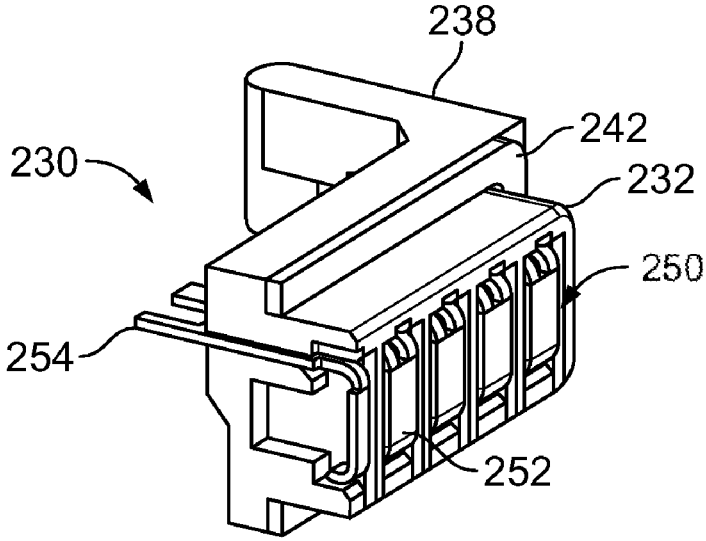
FIG. 2J is a cross-sectional view of the plate connector.

As shown in FIGS. 2F-1K, hand-held device 216, which may be a scanner, bar-code reader or the like, includes a base 217, a second electronic connector referred to herein as beam connector 230, and a second printed circuit board 262. Beam connector 230 includes a connector body 232 and connector posts 236 and 238 formed on either side of connector body 232. As best shown in FIG. 2J, a plurality of individual electrical contacts 250 are inserted into connector body 232 such that each compliant contact face 252 protrudes slightly from the front portion of connector body 232 and each solder tab 254, which contacts second PCB 262, protrudes from rear portion of connector body 232 between first and second connector posts 236 and 238. A face gasket 242 encircles the front portion of plated connector 230 and forms a seal with the body of hand-held device 216. Epoxy or similar material may be used to seal any gaps between connector body 232 and each contact face 252.

Figure 2K:
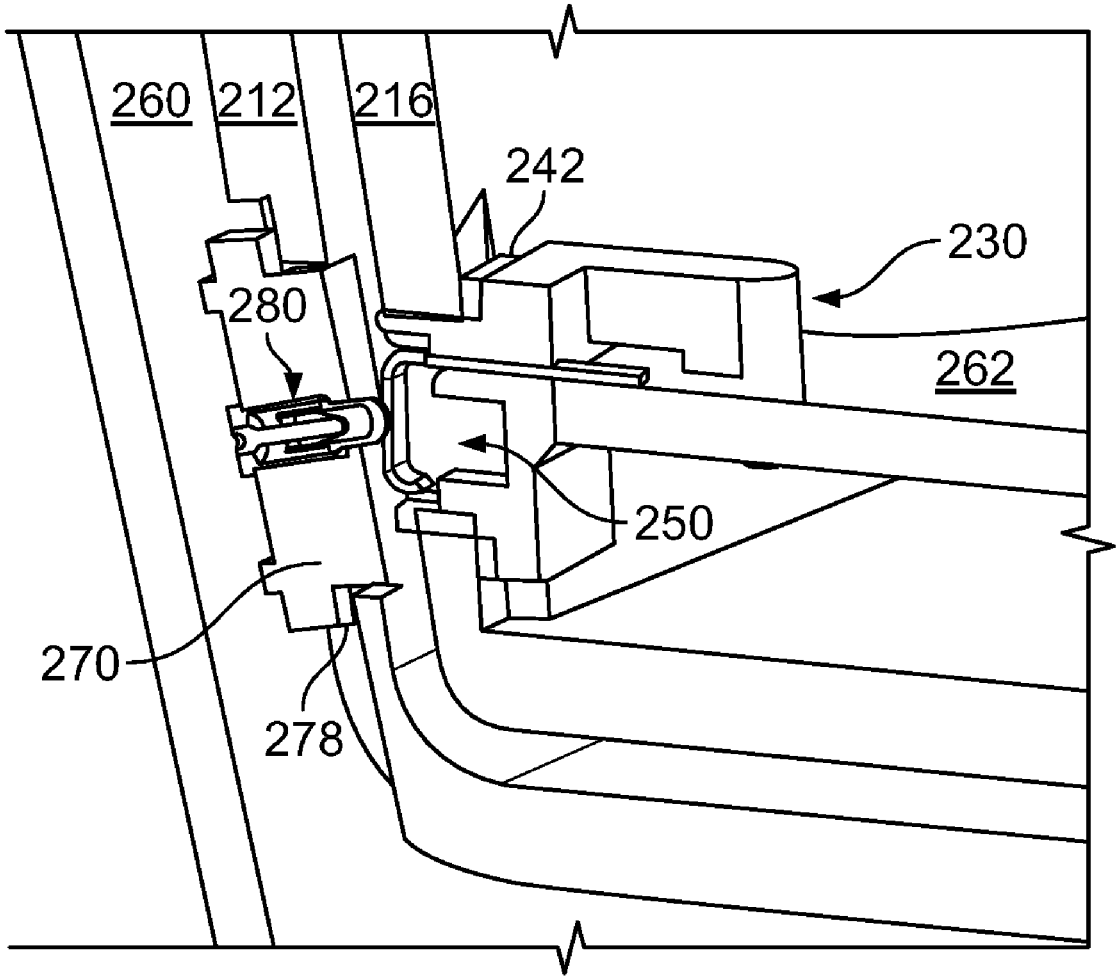
FIG. 2K is a cross-sectional view of a second exemplary embodiment of the sealed connector system of the present invention showing the two connectors in contact with one another.

FIG. 2K provides a cross-sectional view of hand-held device 216 seated in docking station 210, wherein connectors 230 and 270 are in contact with one another to enable electrical communication between printed circuit boards 262 and 260. Gaskets 242 and 278, which may be rubber, plastic, or any other suitable material, seal the openings in hand-held device 216 and docking station 210 in which connectors 230 and 270 are mounted, thereby protecting printed circuit boards 262 and 260 from being damaged by water, oil, dirt or other contaminants.

In both exemplary embodiments disclosed herein, contact surfaces 152 and 252 may be angled or otherwise positioned to permit contact pins 180 and 280 respectively to slide across the contact surfaces in a manner that wipes or cleans the contacts between the components each time a user of the system of the present invention places the hand-held device in the cradle.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A system for connecting electronic components, comprising:

(a) a first electronic component, wherein the first electronic component further includes a first connector mounted therein, and wherein the first connector further includes a plurality of contact surfaces;

(b) a second electronic component for communicating with the first electronic component, wherein the second electronic component further includes a second connector mounted therein, and wherein the second connector further includes a plurality of contact surfaces corresponding to the plurality of contact surfaces on the first connector;

(c) gasket means for sealing a portion of the first connector within the first electronic component; and (d) gasket means for sealing a portion of the second connector within the second electronic component.

2. The system of claim 1, wherein the first electronic component is a docking station and the second electronic component is a hand-held device adapted to function with the docking station.

3. The system of claim 1, wherein the first electronic component further comprises a printed circuit board in electrical communication with the first connector.

4. The system of claim 1, wherein the second electronic component further comprises a printed circuit board in electrical communication with the second connector.

5. The system of claim 1, wherein contact surfaces on the first connector are substantially flat, and wherein contact surfaces on the second connector are substantially pin-shaped, and wherein the contact surfaces on the first connector are angled relative to the contact surfaces on the second connector.

6. The system of claim 1, wherein contact surfaces on the first connector are substantially pin-shaped, and wherein contact surfaces on the second connector are substantially flat, and wherein the contact surfaces on the second connector are angled relative to the contact surfaces on the first connector.

7. The system of claim 1, wherein the means for sealing a portion of the first connector within the first electronic component further comprises a gasket encircling a portion of the first connector, and wherein the means for sealing a portion of the second connector within the second electronic component further comprises a gasket encircling a portion of the second connector.

8. A system for connecting a hand-held device and a docking station, comprising:

(a) a docking station, wherein the docking station further includes a first connector mounted therein, and wherein the first connector further includes a plurality of electrical contact surfaces;

(b) a hand-held device for communicating electronically with the docking station, wherein the hand-held device further includes a second connector mounted therein, and wherein the second connector further includes a plurality of electrical contact surfaces corresponding to the plurality of electrical contact surfaces on the docking station;

(c) gasket means for sealing a portion of the first connector within docking station; and (d) gasket means for sealing a portion of the second connector within the hand-held device.

9. The system of claim 8, wherein the docking station further comprises a printed circuit board in electrical communication with the first connector.

10. The system of claim 8, wherein the hand-held device further comprises a printed circuit board in electrical communication with the second connector.

11. The system of claim 8, wherein contact surfaces on the first connector are substantially flat, and wherein contact surfaces on the second connector are substantially pin-shaped.

12. The system of claim 8, wherein contact surfaces on the first connector are substantially pin-shaped, and wherein contact surfaces on the second connector are substantially flat.

13. A method for connecting electrical components to one another, comprising:

(a) providing a first electronic component, wherein the first electronic component further includes a first connector mounted therein, and wherein the first connector further includes a plurality of contact surfaces;

(b) providing a second electronic component, wherein the second electronic component further includes a second connector mounted therein, and wherein the second connector further includes a plurality of contact surfaces corresponding to the plurality of contact surfaces on the first connector;

(c) providing means for sealing a portion of the first connector within the first electronic component;

(d) providing means for sealing a portion of the second connector within the second electronic component; and (e) detachably connecting the first connector and the second connector for enabling electrical communication between the first and second electronic components.

14. The method of claim 13, wherein the first electronic component is a docking station and the second electronic component is a hand-held device adapted to function with the docking station.

15. The method of claim 13, wherein the first electronic component further comprises a printed circuit board in electrical communication with the first connector.

16. The method of claim 13, wherein the second electronic component further comprises a printed circuit board in electrical communication with the second connector.

17. The method of claim 13, wherein contact surfaces on the first connector are substantially flat, and wherein contact surfaces on the second connector are substantially pin-shaped, and wherein the contact surfaces on the first connector are angled relative to the contact surfaces on the second connector.

18. The method of claim 13, wherein contact surfaces on the first connector are substantially pin-shaped, and wherein contact surfaces on the second connector are substantially flat, and wherein the contact surfaces on the second connector are angled relative to the contact surfaces on the first connector.

19. The method of claim 13, wherein the means for sealing a portion of the first connector within the first electronic component further comprises gasket means encircling a portion of the first connector, and wherein the means for sealing a portion of the second connector within the second electronic component further comprises gasket means encircling a portion of the second connector.

* * * * *